US006755300B2

(12) United States Patent
Brizzi

(10) Patent No.: US 6,755,300 B2
(45) Date of Patent: Jun. 29, 2004

(54) FLAT BLANK FROM WHICH TO FORM A RIGID PACKET

(75) Inventor: Marco Brizzi, Zola Predosa (IT)

(73) Assignee: G. D. Societa'per Azioni, Battindamo (IT)

( * ) Notice: Subject to any disclaimer, the term of this patent is extended or adjusted under 35 U.S.C. 154(b) by 206 days.

(21) Appl. No.: 09/951,915

(22) Filed: Sep. 13, 2001

(65) Prior Publication Data

US 2003/0047471 A1 Mar. 13, 2003

(51) Int. Cl.[7] ..... B65D 85/10
(52) U.S. Cl. ..... 206/273; 229/160.1; 229/930
(58) Field of Search ..... 206/271, 273, 206/264, 242; 229/930, 931, 160.1

(56) References Cited

U.S. PATENT DOCUMENTS 4,022,372 A * 5/1977 Graser ..... 206/193
4,753,384 A 6/1988 Focke et al. ..... 229/160
4,817,803 A * 4/1989 Risucci ..... 229/101.2
5,273,206 A * 12/1993 Vassiliou ..... 229/117.01

* cited by examiner

*Primary Examiner*—Jacob K. Ackun
(74) *Attorney, Agent, or Firm*—Marshall, Gerstein & Borun LLP

(57) ABSTRACT

A flat blank from which to form a rigid cigarette packet with a hinged lid; the blank being substantially parallelepiped-shaped, and having a number of preweakened fold segments with at least two different degrees of weakness.

18 Claims, 3 Drawing Sheets

FLAT BLANK FROM WHICH TO FORM A RIGID PACKET

The present invention relates to a flat blank from which to form a rigid packet.

The flat blank in question may be used to advantage, though not exclusively, for producing a rigid cigarette packet, and normally comprises a cup-shaped bottom portion or container and a top lid connected to each other by a hinge.

BACKGROUND OF THE INVENTION

Known rigid packets of the type described above normally have a rectangular section, though rigid cigarette packets have also been proposed with other, e.g. octagonal or similar, sections.

A rigid packet of the type described above is known to be produced from a flat, substantially rectangular cardboard blank having a number of longitudinal and transverse fold segments, along which the blank is folded to form the packet, in which the longitudinal fold segments normally define, laterally, two parallel major lateral walls and two parallel minor lateral walls perpendicular to the major walls.

Often, the walls of the finished packet, in particular the major walls, are not perfectly flat, on account of the tendency of the blank, when folded along a fold segment, to spring back to its original flat shape.

To reduce springback, it has been proposed to equip packing machines with weakening units for prefolding and weakening the blanks along the fold segments. Though effective, such a solution has been found to involve considerable cost, on account of the complex mechanical design of the weakening units.

SUMMARY OF THE INVENTION

It is an object of the present invention to provide a flat blank enabling straightforward, low-cost production of a rigid packet designed to eliminate the aforementioned drawback, i.e. a packet with substantially flat walls.

According to the present invention, there is provided a flat blank from which to produce a rigid packet, the blank comprising a number of preweakened fold segments, and being characterized by said fold segments having at least two different degrees of weakness.

Said fold segments are preferably so located as to form respective sharp edges once the blank is folded to form said packet.

Tests have surprisingly shown that, regardless of the shape of the packet, curving of the walls of the packet due to springback of the blank is substantially eliminated by weakening some fold segments more than others. Which fold segments are to be weakened most to achieve the desired effect obviously depends on the shape of the packet, and must be established substantially by trial and error. Nevertheless, tests have shown that any type of packet has a particular combination of fold segments which, if weakened to a greater degree, provide for obtaining almost perfectly flat walls without impairing the shape stability of the packet.

Take, for example, the case of a substantially octagonal-section packet formed from a substantially rectangular blank comprising longitudinal and transverse fold segments, and wherein the longitudinal fold segments are aligned along at least two inner longitudinal and two outer longitudinal fold lines. Such a packet is defined by a cup-shaped body and by a lid hinged to the cup-shaped body; the cup-shaped body and the lid have respective major lateral walls and respective minor lateral walls; and the transverse fold segments divide a portion of the blank extending between the two inner longitudinal fold lines into a first panel corresponding to a first major lateral wall of the cup-shaped body, and a second panel corresponding to a second major lateral wall of the cup-shaped body.

In this particular case, the walls of the packet can be flattened by weakening to a greater degree than the other fold segments of the blank the two longitudinal fold segments located on either side of the first panel and each defining a portion of a respective inner longitudinal fold line, and the two longitudinal fold segments located on either side of the second panel and each defining a portion of a respective outer longitudinal fold line.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
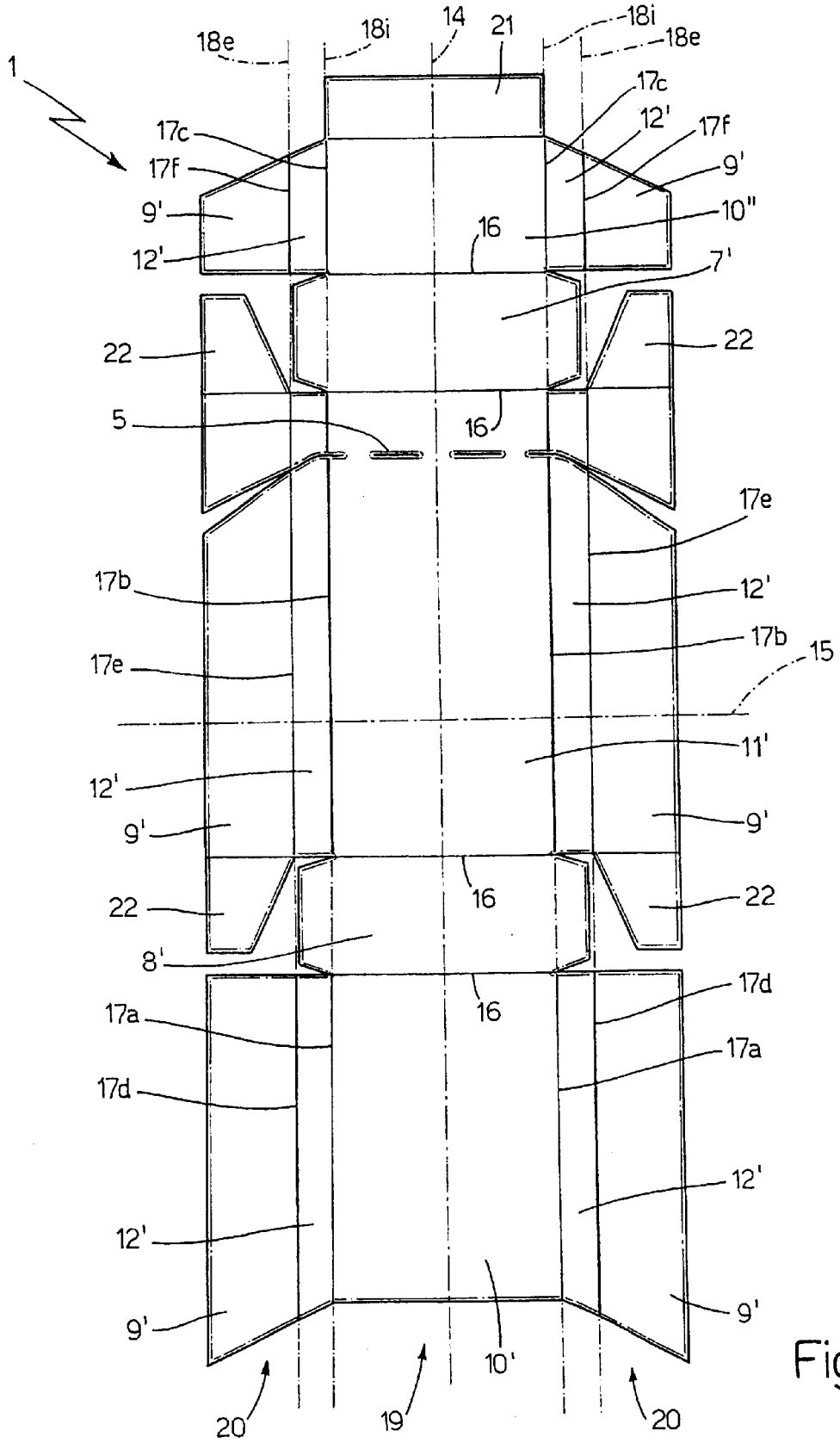
FIG. 1 shows a plan view of a preferred embodiment of the blank according to the present invention.

Number 1 in FIG. 1 indicates as a whole a flat blank of cardboard or similar, which is foldable in known manner to form a rigid cigarette packet 2 (FIG. 2), in particular an octagonal-section packet of the type described in Patent EP-B1-204933. Packet 2 comprises a cup-shaped bottom container 3 with an open top end (not shown); and a cup-shaped top lid 4 hinged to container 3 along a hinge 5 (FIG. 1) to rotate, with respect to container 3, between an open position (not shown) and a closed position (FIG. 2) closing the open top end (not shown).

Lid 4, when closed, imparts to packet 2 a substantially right-parallelepiped shape defined by a lateral surface 6, and by two identical flat top and bottom end walls 7 and 8 axially defining lateral surface 6 and positioned parallel to and facing each other.

Lateral surface 6 comprises two flat minor lateral walls 9 parallel to and facing each other; and two flat front and rear major lateral walls 10 and 11 parallel to and facing each other and perpendicular to minor lateral walls 9. Minor lateral walls 9 and major lateral walls 10 and 11 are connected to one another by four flat connecting walls 12, each forming respective sharp edges 13 with the adjacent lateral walls 9, 10 and 11.

Figure 2:
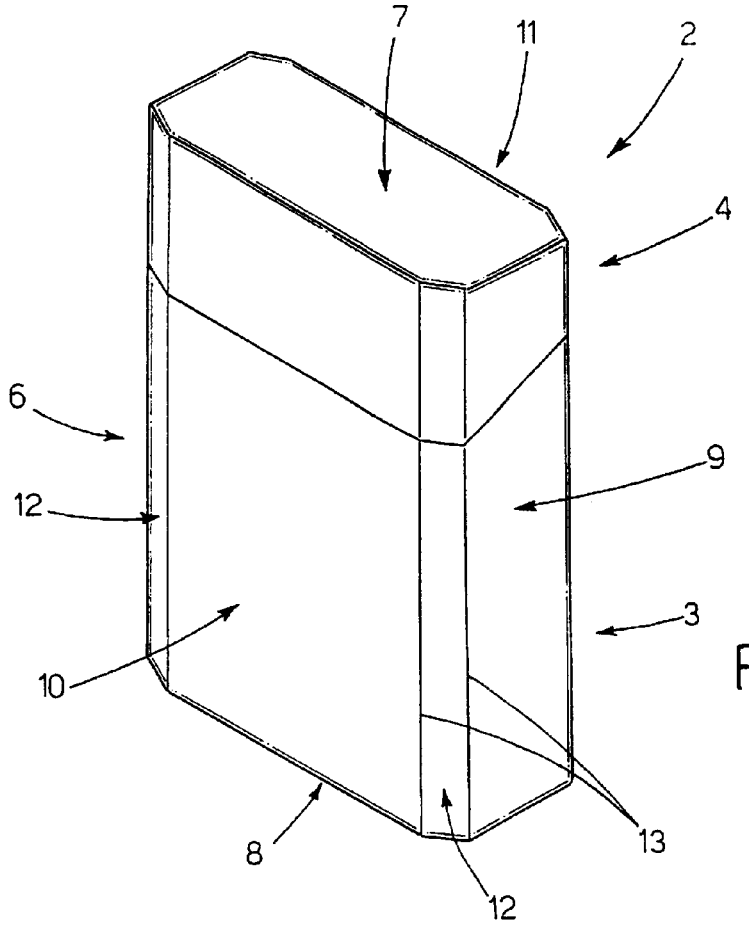
FIG. 2 shows a three-quarter top view in perspective of a cigarette packet formed from the FIG. 1 blank.

As shown clearly in FIG. 2, lid 4 comprises top end wall 7 and a top portion of lateral surface 6; and container 3 comprises bottom end wall 8 and the remaining bottom portion of lateral surface 6.

For the sake of clarity, the parts of blank 1 will be indicated hereinafter, wherever possible, using the same reference numbers, with superscripts, as for the corresponding parts of packet 2.

Blank 1 is substantially in the form of an elongated rectangle having a longitudinal central axis 14 and a transverse central axis 15 perpendicular to axis 14. Blank 1 comprises a number of preweakened transverse fold segments 16, i.e. parallel to transverse axis 15, and a number of preweakened longitudinal fold segments 17, i.e. parallel to longitudinal axis 14, along which blank 1 is folded to form packet 2. More specifically, fold segments 16 and 17 are so located as to form respective sharp edges once blank 1 is folded to form packet 2.

Longitudinal fold segments 17 are aligned with one another along four longitudinal lines 18 arranged side by side in pairs; and the longitudinal lines 18 in each pair are located one outwards (18*e*) and one inwards (18*i*) with respect to longitudinal central axis 14 of blank 1.

The inner longitudinal lines 18*i* divide blank 1 into a central strip 19 and two lateral strips 20 on either side of strip 19. Working upwards in FIG. 1, transverse fold segments 16 divide central strip 19 into a panel 10' defined laterally by two fold segments 17*a* aligned with inner longitudinal lines 18*i*; a panel 8'; a panel 11' defined laterally by two fold segments 17*b* aligned with inner longitudinal lines 18*i*; a panel 7'; and a panel 10" defined laterally by two fold segments 17*c* aligned with inner longitudinal lines 18*i*.

Panel 11' corresponds to rear major lateral wall 11 of packet 2, and therefore of container 3 and lid 4, and comprises hinge 5 connecting container 3 and lid 4; panel 10' corresponds to the container 3 portion of front major lateral wall 10, and panel 10" to the lid 4 portion of front major lateral wall 10; and panel 10" is joined to a reinforcing strip 21, which is folded onto panel 10", to increase the rigidity of major lateral wall 10 of lid 4.

Blank 1 also comprises panels 12' located symmetrically on either side of panels 10', 10" and 11' to define connecting walls 12 of packet 2. The panels 12' connected to panel 10' are defined internally by fold segments 17*a*, and externally by respective fold segments 17*d* aligned with outer longitudinal lines 18*e*; the panels 12' connected to panel 11' are defined internally by fold segments 17*b*, and externally by respective fold segments 17*e* aligned with outer longitudinal lines 18*e*; and the panels 12' connected to panel 10" are defined internally by fold segments 17*c*, and externally by respective fold segments 17*f* aligned with outer longitudinal lines 18*e*.

Finally, blank 1 also comprises wings 9', which are folded squarely and overlapped to define minor lateral walls 9 of packet 2; and connecting tongues 22 connected to wings 9' and for imparting stability to packet 2.

In the FIG. 1 embodiment, longitudinal fold segments 17*b*, 17*d*, 17*f* have a first degree of weakness, and the other longitudinal fold segments 17*a*, 17*c*, 17*e* and transverse fold segments 16 a second degree of weakness lower than the first. In other words, longitudinal fold segments 17*b*, 17*d*, 17*f* are weakened to a greater extent than the other fold segments 16 and 17.

Figure 3:
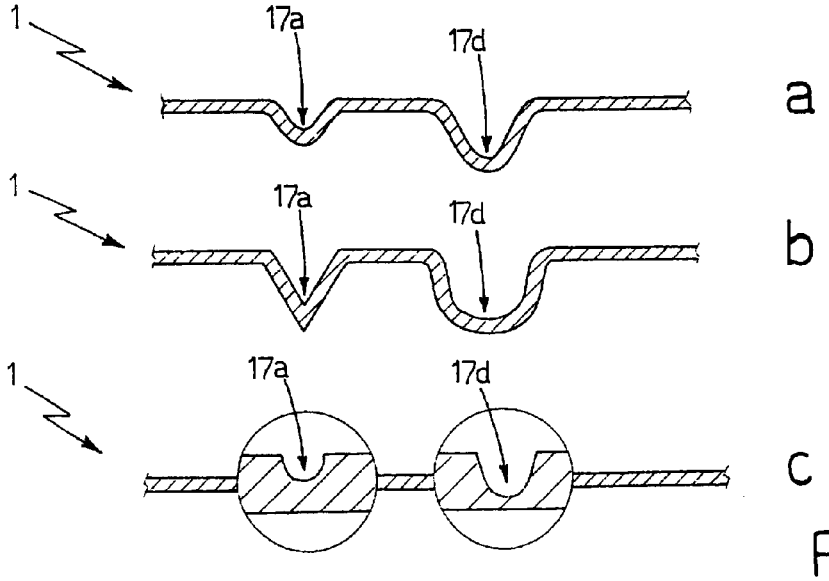
FIG. 3 shows larger-scale cross sections of three embodiments of a detail of the FIG. 1 blank.

As shown in FIG. 3*a* or 3*b*, each fold segment 16 and 17 is defined by a respective deformation, of given shape and size, of blank 1; and, to achieve different degrees of weakness of the various longitudinal segments 17, longitudinal segments 17 are defined by respective deformations of different shapes and/or sizes.

In an alternative embodiment shown in FIG. 3*c*, each fold segment 16 and 17 is defined by a respective incision, of given shape and size, of blank 1; and, to achieve different degrees of weakness of the various longitudinal segments 17, longitudinal segments 17 are defined by respective incisions of different shapes and/or sizes.

In further embodiments not shown, the location of the more highly weakened fold segments 16 and/or 17 may vary. It should be stressed that the number of more highly weakened fold segments 16 and/or 17 is preferably limited to maintain a stable shape of packet 2 even when almost empty and not called upon to stabilize the group of cigarettes inside.

Figure 4:
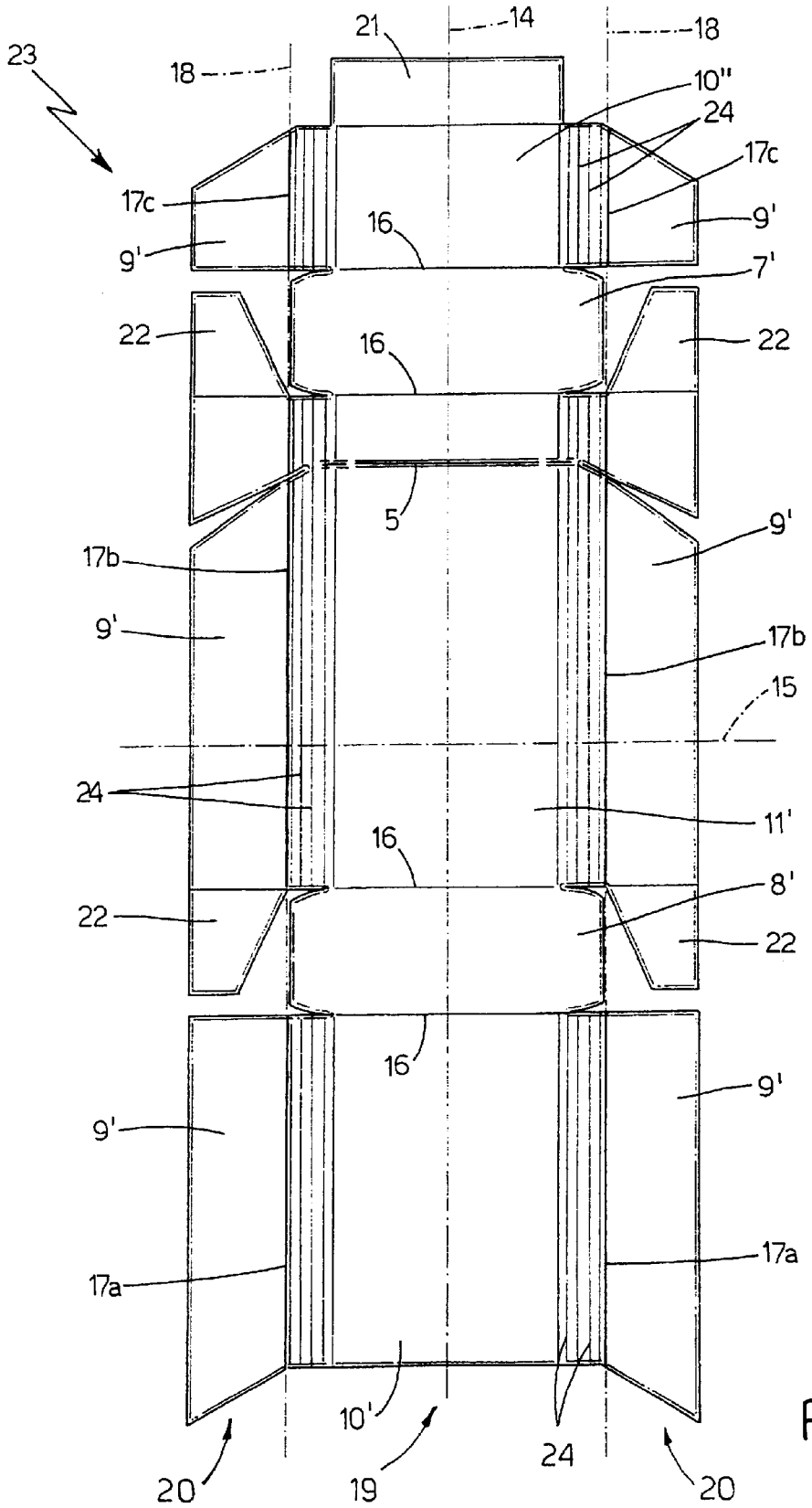
FIG. 4 shows a plan view of an alternative embodiment of the blank according to the present invention.

Number 23 in FIG. 4 indicates as a whole a flat blank of cardboard or similar, which is folded in known manner to form a rigid cigarette packet (not shown) of the type described in Patent Application ITA-BO99A000029, in which the major lateral walls are outwardly convex and connected to the minor lateral walls along respective sharp edges perpendicular to the end walls.

Being similar to blank 1 in FIG. 1, the parts of blank 23 will be indicated hereinafter, wherever possible and for the sake of simplicity, using the same reference numbers as for the corresponding parts of blank 1.

In blank 23, longitudinal fold segments 17 are aligned along two longitudinal lines 18, which divide blank 23 into a central strip 19 and two lateral strips 20 on either side of strip 19. Working upwards in FIG. 4, transverse fold segments 16 divide central strip 19 into a panel 10' defined laterally by two fold segments 17*a*; a panel 8'; a panel 11' defined laterally by two fold segments 17*b*; a panel 7'; and a panel 10" defined laterally by two fold segments 17*c*.

Panels 10', 10" and 11' comprise longitudinal fold segments 24 located close to longitudinal lines 18 and which, in known manner, impart a curved shape to the outer portions of major lateral walls 10 and 11.

The difference between fold segments 24 and fold segments 16 and 17 lies in fold segments 16 and 17 being so formed and located as to form respective sharp edges once blank 23 is folded to form the corresponding packet, whereas fold segments 24 are so formed and located as to locally curve blank 23 with no sharp edges once blank 23 is folded to form the corresponding packet.

Blank 23 also comprises wings 9', which are folded squarely and overlapped to define minor lateral walls 9 of the packet; and connecting tongues 22 connected to wings 9' and for imparting stability to the packet.

In the FIG. 4 embodiment, longitudinal fold segments 17 all have a first degree of weakness, and longitudinal fold segments 24 all have a second degree of weakness lower than the first. In other words, longitudinal fold segments 17 are all weakened to a greater extent than longitudinal fold segments 24.

In a further embodiment not shown (which applies to both the FIG. 1 and FIG. 4 blanks), some transverse fold segments and some longitudinal fold segments have the first degree of weakness, and the other fold segments all have the second degree of weakness lower than the first.

In a further embodiment not shown (which applies to both the FIG. 1 and FIG. 4 blanks), only limited portions of some fold segments have the first degree of weakness, while the remaining portions of the same fold segments and the other fold segments have the second degree of weakness lower than the first.

In a further embodiment not shown (which applies to both the FIG. 1 and FIG. 4 blanks), the fold segments have three or more different degrees of weakness.

What is claimed is:

1. A substantially rectangular flat blank from which to produce a rigid packet (2), the rigid packet comprising a cup-shaved body (3), and a lid (4) hinged to said cup-shaved body (3); the cup-shaped body (3) and the lid (4) having respective major lateral walls (10, 11) and respective minor lateral walls (9); the blank (1; 23) comprising a number of preweakened fold segments (16,17; 16,17,24) having at least two different degrees of weakness; said fold segments (16,17; 16,17,24) comprising a number of longitudinal fold segments (17; 17,24) and a number of transverse fold segments (16); some (17*d*,17*b*,17*f*; 17) of said longitudinal fold segments (17,24) having a first degree of weakness, and the others (17*a*,17*e*,17*c*; 24) a second degree of weakness lower than said first degree of weakness; said longitudinal fold segments (17) are aligned with one another alone at least two outer longitudinal lines (18*e*) and two inner longitudinal lines (18*i*) extending alone a portion of the blank extending between said two outer longitudinal lines (18*e*); said transverse fold segments (16) dividing the blank (1), between said two inner longitudinal lines (18*i*), into a first panel (10') corresponding to a first major lateral wail (10) of the cup-shaped body (3), and into a second panel (11') corresponding to a second major lateral wall (11) of the cup-shaped body (3); the two longitudinal segments (17*d*) located on opposite sides of said first panel (10'), and each defining part of a respective said outer longitudinal line (18*e*), and the two longitudinal segments (17*b*) located on opposite sides of said second panel (11'), and each defining part of a respective said inner longitudinal line (18*i*), having a degree of weakness greater than all the other said longitudinal fold segments (17).

2. The blank of claim 1, wherein said fold segments (16,17; 16,17,24) comprise at least a first (17*d*,17*b*,17*f*; 17) and a second (16,17*a*,17*e*,17*c*; 16,24) series of fold segments having, respectively, a first degree of weakness and a second degree of weakness lower than said first degree of weakness.

3. The blank of claim 1, wherein said transverse fold segments (16) all have said second degree of weakness.

4. The blank of claim 1, wherein said packet (2) comprises a cup-shaped body (3), and a lid (4) hinged to said cup-shaped body (3); the cup-shaped body (3) and the lid (4) having respective major lateral walls (10, 11) and respective minor lateral walls (9); said transverse fold segments (16) dividing the blank (1), between said two inner longitudinal lines (18*i*), into a first panel (10') corresponding to a first major lateral wall (10) of the cup-shaped body (3), into a second panel (11') corresponding to a second major lateral wall (11) of the cup-shaped body (3) and of the lid (4), and into a third panel (10") corresponding to a first major lateral wall (10) of the lid (4); the two longitudinal segments (17*d*) located on opposite sides of said first panel (10'), and each defining part of a respective outer longitudinal line (18*e*), the two longitudinal segments (17*b*) located on opposite sides of said second panel (11'), and each defining part of a respective said inner longitudinal line (18*i*), and the two longitudinal segments (17*f*) located on opposite sides of said third panel (10"), and each defining part of a respective said outer longitudinal line (18*e*), having a degree of weakness greater than all the other said longitudinal fold segments (17).

5. The blank of claim 1, wherein said first longitudinal fold segments (17) are aligned with one another along at least two longitudinal lines (18); said packet (2) comprising a cup-shaped body (3) and a lid (4) hinged 10 said cup-shaped body (3); the cup-shaped body (3) and the lid (4) having respective major lateral walls (10, 11) and respective minor lateral walls (9); said transverse fold segments (16) dividing the blank (1), between said two longitudinal lines (18), into a first panel (10') corresponding to a first major lateral wall (10) of the cup-shaped body (3), into a second panel (11') corresponding to a second major lateral wall (11) of the cup-shaped body (3), and into a third panel (10") corresponding to a said first major lateral wall (10) of the lid (4); each said panel (10',11',10") being defined by respective said first longitudinal fold segments (17), each of which defines part of a respective said longitudinal line (18), and comprising respective second longitudinal fold segments (24) located close to said longitudinal lines (18) to impart a curved shape to the outer portions of the panel (10',11',10"); said first longitudinal fold segments (17) having a greater degree of weakness than said second longitudinal fold segments (24).

6. The blank of claim 1, wherein each said fold segment (16,17; 16,17,24) is defined by an incision, of given shape and size, of said blank (1; 23); said fold segments (16,17; 16,17,24) being defined by incisions of different shapes and/or sizes.

7. The blank of claim 1, wherein each said fold segment (16,17; 16,17,24) is defined by a deformation, of given shape and size, of said blank (1); said fold segments (16,17; 16,17,24) being defined by deformations of different shapes and/or sizes.

8. A rigid cigarette packet formed from a flat blank (1; 23) having the characteristics described in claim 7.

9. A flat blank (1) from which to produce a packet (2) for tobacco products; the packet (2) comprising a cup-shaped container (3) with an open end and a cup-shaped lid (4) hinged to container (3) along a hinge (5) to rotate, with respect to container (3), between an open position and a closed position closing the open end; the packet (2) comprising a lateral surface (6), and a flat top and bottom end wall (7,8) facing and parallel to each other and defining the lateral surface (6); the lateral surface (6) comprising two facing flat minor lateral walls (9) and two facing major lateral walls (10, 11); the blank (1) being substantially rectangular and comprising at least two preweakened longitudinal fold segments (17; 17,24), and a number of preweakened transverse fold segments (16) defining, between said two preweakened longitudinal fold segments (17; 17, 24), a first panel (7') corresponding to a relevant bottom end wall (7), a second panel (11') corresponding to a relevant major lateral wall (11), a third panel (8') corresponding to a relevant bottom end wall (8), and a fourth panel (10') corresponding to a relevant major lateral wall (10); each of said second and fourth panels (11',10') having two respective opposite longitudinal lateral wings (9') corresponding to the minor lateral walls (9); the blank (1) comprising said hinge (5); said fold segments (16,17; 16,17, 24) having at least two different degrees of weakness.

10. The blank of claim 9, wherein said fold segments (16,17; 16,17,24) comprise at least a first (17*d*,17*b*,17*f*; 17) and a second (16,17*a*,17*e*,17*c*; 16,24) series of fold segments having, respectively, a first degree of weakness and a second degree of weakness lower than said first degree of weakness.

11. The blank of claim 9, wherein some (17*d*,17*b*,17*f*; 17) of said preweakened longitudinal fold segments (17,24) has a first degree of weakness, and the others (17*a*,17*e*,17*c*; 24) a second degree of weakness lower than said first degree of weakness.

12. The blank of claim 11, wherein the transverse fold segments (16) all have said second degree of weakness.

13. A substantially rectangular flat blank from which to produce a rigid packet (2) comprises a cup-shaped body (3), and a lid (4) hinged to said cup-shaped body (3); the cup-shaped body (3) and the lid (4) having respective major lateral walls (10, 11) and respective minor lateral walls (9); the blank (1; 23) comprising a number of preweakened fold segments (16,17; 16,17,24) having at least two different degrees of weakness, said fold segments (16,17; 16,17,24) comprising a number of longitudinal fold segments (17; 17,24) and a number of transverse fold segments (16); some (17*d*,17*b*,17*f*; 17) of said longitudinal fold segments (17,24) having a first degree of weakness, and the others (17*a*,17*e*, 17*c*; 24) a second degree of weakness lower than said first degree of weakness; said first longitudinal fold segments (17) being aligned with one another along at least two longitudinal lines (18); said transverse fold segments (16) dividing the blank (1), between said two longitudinal lines (18), into a first panel (10') corresponding to a first major lateral wall (10) of the cup-shaped body (3), into a second panel (11') corresponding to a second major lateral wall (11) of the cup-shaped body (3), and into a third panel (10") corresponding to a said first major lateral wall (10) of the lid (4); each said panel (10',11',10") being defined by respective said first longitudinal fold segments (17), each of which defines part of a respective said longitudinal line (18), and comprising respective second longitudinal fold segments (24) located close to said longitudinal lines (18) to impart a curved shape to the outer portions of the panel (10',11',10"); said first longitudinal fold segments (17) having a greater degree of weakness than said second longitudinal fold segments (24).

14. A flat blank (1) from which to produce a substantially parallelepiped-shaped, rigid hinged-lid packet (2) for tobacco products; the packet (2) comprising a lateral surface (6), and a flat top and bottom end wall (7,8) facing and parallel to each other and defining the lateral surface (6); the lateral surface (6) comprising two facing flat minor lateral walls (9) and two facing major lateral walls (10, 11); the blank (1) being substantially rectangular and comprising at least two preweakened inner longitudinal fold segments (17; 17,24), at least two preweakened outer longitudinal fold segments, and a number of preweakened transverse fold segments (16), wherein the transverse fold segments (16) and the inner longitudinal fold segments (17; 17,24) define between the inner longitudinal fold segments a first panel (7') corresponding to a relevant top end wall (7), a second panel (11') corresponding to a relevant major lateral wall (11), a third panel (8') corresponding to a relevant bottom end wall (8), and a fourth panel (10') corresponding to a relevant major lateral wall (10); each of said second and fourth panels (11',10') having two respective opposite longitudinal lateral wings (9') corresponding to the minor lateral walls (9); said outer longitudinal fold segments, inner longitudinal fold segments, and transverse fold segments (16, 17; 16,17,24) having at least two different degrees of weakness.

15. A rigid packet (2) for tobacco products; the packet (2) comprising a cup-shaped container (3) with an open end and a cup-shaped lid (4) hinged to container (3) along a hinge (5) to rotate, with respect to container (3), between an open position and a closed position closing the open end; the packet (2) comprising a lateral surface (6), and a flat top and bottom end wall (7, 8) facing and parallel to each other and defining the lateral surface (6); the lateral surface (6) comprising two facing flat minor lateral walls (9) and two facing major lateral walls (10,11); the packet (2) being defined by a substantially rectangular flat blank (1), the flat blank (1) comprising at least two preweakened longitudinal fold segments (17; 17,24), and a number of preweakened transverse fold segments (16) defining, between said two preweakened longitudinal fold segments (17; 17,24), a first panel (7') corresponding to a relevant bottom end wall (7), a second panel (11') corresponding to a relevant major lateral wall (11), a third panel (8') corresponding to a relevant bottom end wall (8), and a fourth panel (10') corresponding to a relevant major lateral wall (10); each of said second and fourth panels (11', 10') having two respective opposite longitudinal lateral wings (9') corresponding to the minor lateral walls (9); the blank (1) comprising said binge (5); said fold segments (16,17; 16,17,24) having at least two different degrees of weakness.

16. The packet of claim 15, wherein said fold segments (16,17; 16,17,24) comprise at least a first (17*d*,17*b*,17*f*; 17) and a second (16,17*a*,17*e*,17*c*; 16,24) series of fold segments having, respectively, a first degree of weakness and a second degree of weakness lower than said first degree of weakness.

17. The packet of claim 15, wherein some (17*d*,17*b*,17*f*; 17) of said preweakened longitudinal fold segments (17,24) has a first degree of weakness, and the others (17*a*,17*e*,17*c*; 24) a second degree of weakness lower than said first degree of weakness.

18. The packet of claim 15, wherein the transverse fold segments (16) all have said second degree of weakness.

* * * * *

UNITED STATES PATENT AND TRADEMARK OFFICE

CERTIFICATE OF CORRECTION

PATENT NO. : 6,755,300 B2
DATED : June 29, 2004
INVENTOR(S) : Marco Brizzi

It is certified that error appears in the above-identified patent and that said Letters Patent is hereby corrected as shown below:

Title page,
Item [73], Assignee, "G.D. Societa' per Azioni" should be -- G.D Societa' per Azioni --

Column 4,
Line 65, (both occurrences), "cup-shaved" should be -- cup-shaped --

Column 5,
Lines 10 and 12, "alone" should be -- along --
Line 16, "wail" should be -- wall --
Line 59, "hinged 10" should be -- hinged to --

Column 8,
Line 27, "comprising said binge" should be -- comprising said hinge --

Signed and Sealed this

Second Day of November, 2004

JON W. DUDAS
*Director of the United States Patent and Trademark Office*

US006755300C1

(12) EX PARTE REEXAMINATION CERTIFICATE (10001st)

United States Patent

Brizzi

(10) Number: US 6,755,300 C1

(45) Certificate Issued: Jan. 9, 2014

(54) FLAT BLANK FROM WHICH TO FORM A RIGID PACKET

(75) Inventor: Marco Brizzi, Zola Predosa (IT)

(73) Assignee: G.D Societa' per Azioni (IT)

Reexamination Request:
No. 90/012,526, Sep. 13, 2012

Reexamination Certificate for:

| | |
|---|---|
| Patent No.: | **6,755,300** |
| Issued: | **Jun. 29, 2004** |
| Appl. No.: | **09/951,915** |
| Filed: | **Sep. 13, 2001** |

Certificate of Correction issued Nov. 2, 2004

(51) Int. Cl.
*B65D 85/10* (2006.01)

(52) U.S. Cl.
USPC ..... 206/273; 229/160.1; 229/930

(58) Field of Classification Search
None
See application file for complete search history.

(56) References Cited

To view the complete listing of prior art documents cited during the proceeding for Reexamination Control Number 90/012,526, please refer to the USPTO's public Patent Application Information Retrieval (PAIR) system under the Display References tab.

*Primary Examiner* — Jeffrey L. Gellner

(57) ABSTRACT

A flat blank from which to form a rigid cigarette packet with a hinged lid; the blank being substantially parallelepiped-shaped, and having a number of preweakened fold segments with at least two different degrees of weakness.

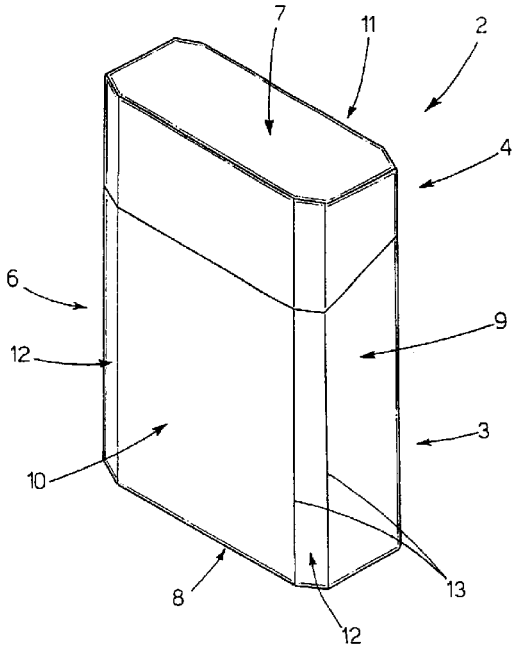

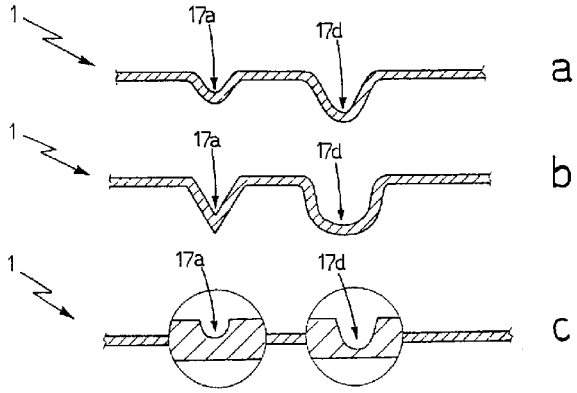

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4 and 9-18 are cancelled.

Claims 1 and 5 are determined to be patentable as amended.

Claims 2, 3 and 6-8, dependent on an amended claim, are determined to be patentable.

1. A substantially rectangular flat blank from which to produce a rigid packet (2), the rigid packet comprising a cup-shaped body (3), and a lid (4) hinged to said cup-shaped body (3);

the cup-shaped body (3) and the lid (4) having respective major lateral walls (10, 11) and respective minor lateral walls (9);

the blank (1; 23) comprising a number of preweakened fold segments (16,17; 16,17,24) having at least two different degrees of weakness;

said fold segments (16,17; 16,17,24) comprising a number of longitudinal fold segments (17; 17,24) and a number of transverse fold segments (16);

some (17d,17b,17f; 17) of said longitudinal fold segments (17,24) having a first degree of weakness, and the others (17a,17e,17c; 24) a second degree of weakness lower than said first degree of weakness;

said longitudinal fold segments (17) are aligned with one another along at least two outer longitudinal lines (18e) and two inner longitudinal lines (18i) extending along a portion of the blank extending between said two outer longitudinal lines (18e);

said transverse fold segments (16) dividing the blank (1), between said two inner longitudinal lines (18i), into a first panel (10') corresponding to a first major lateral wall (10) of the cup-shaped body (3), and into a second panel (11') corresponding to a second major lateral wall (11) of the cup-shaped body (3) *and of the lid* (*4*), *and into a third panel* (*10"*) *corresponding to a first major lateral wall* (*10*) *of the lid* (*4*);

the two longitudinal segments (17d) located on opposite sides of said first panel (10'), and each defining part of a respective said outer longitudinal line (18e), [and] the two longitudinal segments (17b) located on opposite sides of said second panel (11'), and each defining part of a respective said inner longitudinal line (18i), *and the two longitudinal segments* (*17f*) *located on opposite sides of said third panel* (*10"*), *and each defining part of a respective said outer longitudinal line* (*18e*) having a degree of weakness greater than all the other said longitudinal fold segments (17).

5. The blank of claim 1, wherein said first longitudinal fold segments (17) are aligned with one another along at least two longitudinal lines (18);

[said packet (2) comprising a cup-shaped body (3) and a lid (4) hinged to said cup-shaped body (3);

the cup-shaped body (3) and the lid (4) having respective major lateral walls (10, 11) and respective minor lateral walls (9);

said transverse fold segments (16) dividing the blank (1), between said two longitudinal lines (18), into a first panel (10') corresponding to a first major lateral wall (10) of the cup-shaped body (3), into a second panel (11') corresponding to a second major lateral wall (11) of the cup-shaped body (3), and into a third panel (10") corresponding to a said first major lateral wall (10) of the lid (4);] *and* each said panel (10',11',10") being defined by respective said first longitudinal fold segments (17), each of which defines part of a respective said longitudinal line (18), and comprising respective second longitudinal fold segments (24) located close to said longitudinal lines (18) to impart a curved shape to the outer portions of the panel (10',11',10"); said first longitudinal fold segments (17) having a greater degree of weakness than said second longitudinal fold segments (24).

* * * * *